United States Patent [19]

Baptiste

[11] Patent Number: 4,778,050

[45] Date of Patent: Oct. 18, 1988

[54] PACKAGE FOR PACKAGING A SHIRT OR THE LIKE

[76] Inventor: Trevor I. Baptiste, 383 Grand Ave., Brooklyn, N.Y. 11238

[21] Appl. No.: 120,602

[22] Filed: Nov. 13, 1987

[51] Int. Cl.[4] ..... B65D 85/18

[52] U.S. Cl. ..... 206/281; 206/278; 206/458

[58] Field of Search ..... 206/278, 457, 458, 281; D9/319, 415, 457

[56] References Cited

U.S. PATENT DOCUMENTS

| | | | |
|---|---|---|---|
| Re. 32,443 | 6/1987 | Kalal | 206/457 X |
| 329,258 | 10/1885 | Boyce | 206/278 |
| 413,094 | 10/1889 | Samuels | 206/457 |
| 1,907,937 | 5/1933 | Levkoff | 206/458 X |
| 3,256,976 | 6/1966 | Greason | 206/278 |
| 3,978,594 | 9/1976 | Pulitzer et al. | 206/458 X |
| 4,139,095 | 2/1979 | Weaver | 206/278 |

*Primary Examiner*—William Price
*Assistant Examiner*—Sue A. Weaver

[57] ABSTRACT

A shirt package for packaging and displaying a shirt that is color coordinated to compliment the differently colored pants and a drawing label insert placed adjacent thereto. The insert is modified to show at least four pants, in one instance and at least five pants, in the alternative. The transparent polymer package is modified to comprise of dual compartments, one holding the shirt and the other holding the label insert; or to comprise of a singular compartment holding both the shirt and the label insert.

5 Claims, 5 Drawing Sheets

PACKAGE FOR PACKAGING A SHIRT OR THE LIKE

BACKGROUND TO THE INVENTION

This invention relates to a package for packaging a shirt or the like. The objective of every shirt customer, is to have or find a color pants to match a shirt purchase.

The instant invention is directed at providing a shirt package with a paper label insert, showing the drawings of several pants, so that each pants drawing when colored differently, compliment the color of the shirt within the package.

This invention is of particular benefit to a shirt customer who does not have the time to co-ordinate the colors of a shirt and pants purchase, or a customer who lacks the skill or confidence to do so.

Additionally, the invention enables retail stores sales employees to save on time ordinarily spent assisting shirt customers match the colors of a shirt and pants purchase.

SUMMARY OF THE INVENTION

It is the objective of the present invention to provide a package for packaging a shirt or the like, said package having a paper label insert placed at the bottom end thereof, said paper label insert showing the drawings of four or five pants, so that when in use, each differently colored pants drawing compliments the color of the shirt within the package, thus showing four or five shirt and pants color combinations.

DESCRIPTION OF PREFERRED EMBODIMENT

Figure 1:
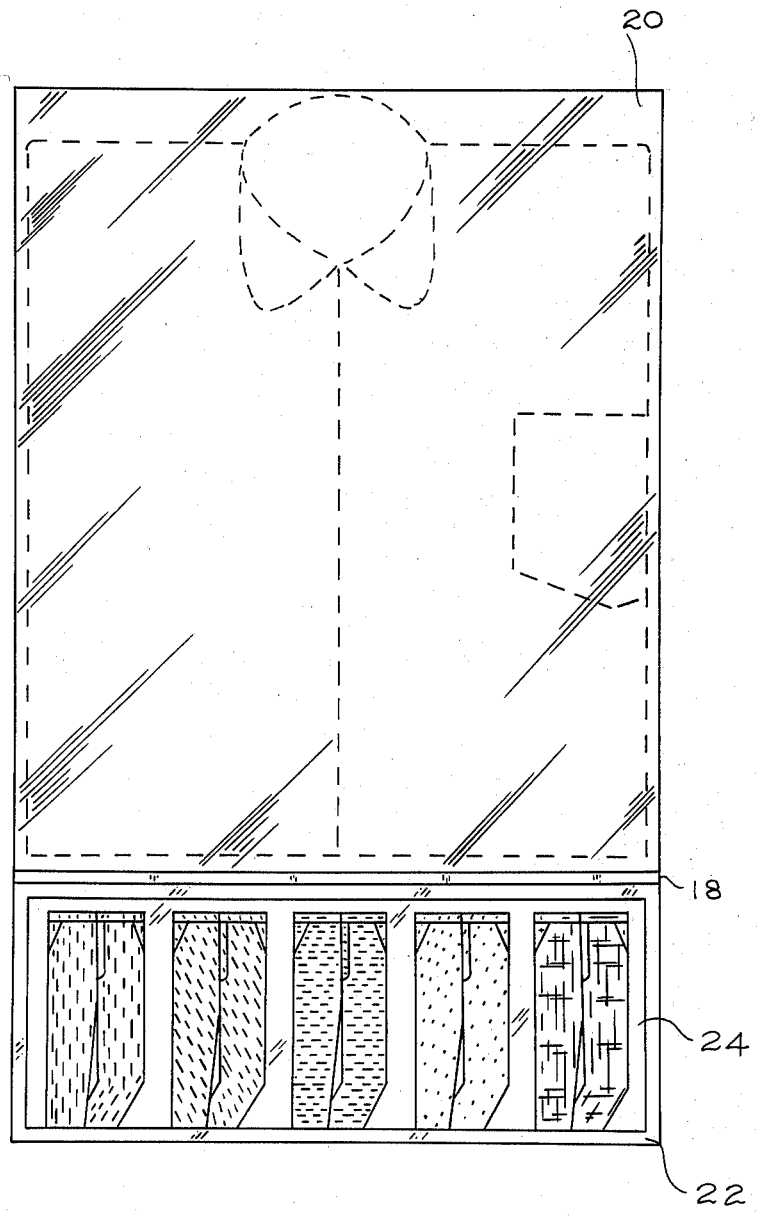
FIG. 1 is a front elevational view of the invention.
Figure 2:
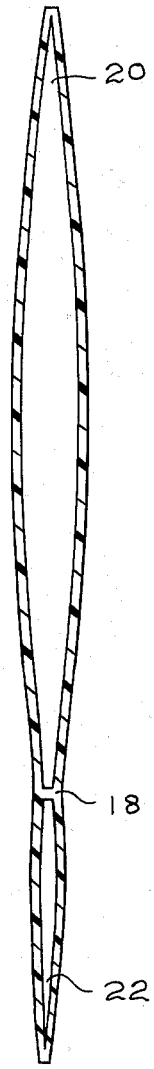
FIG. 2 is a side cross-sectional view thereof.
Figure 3:
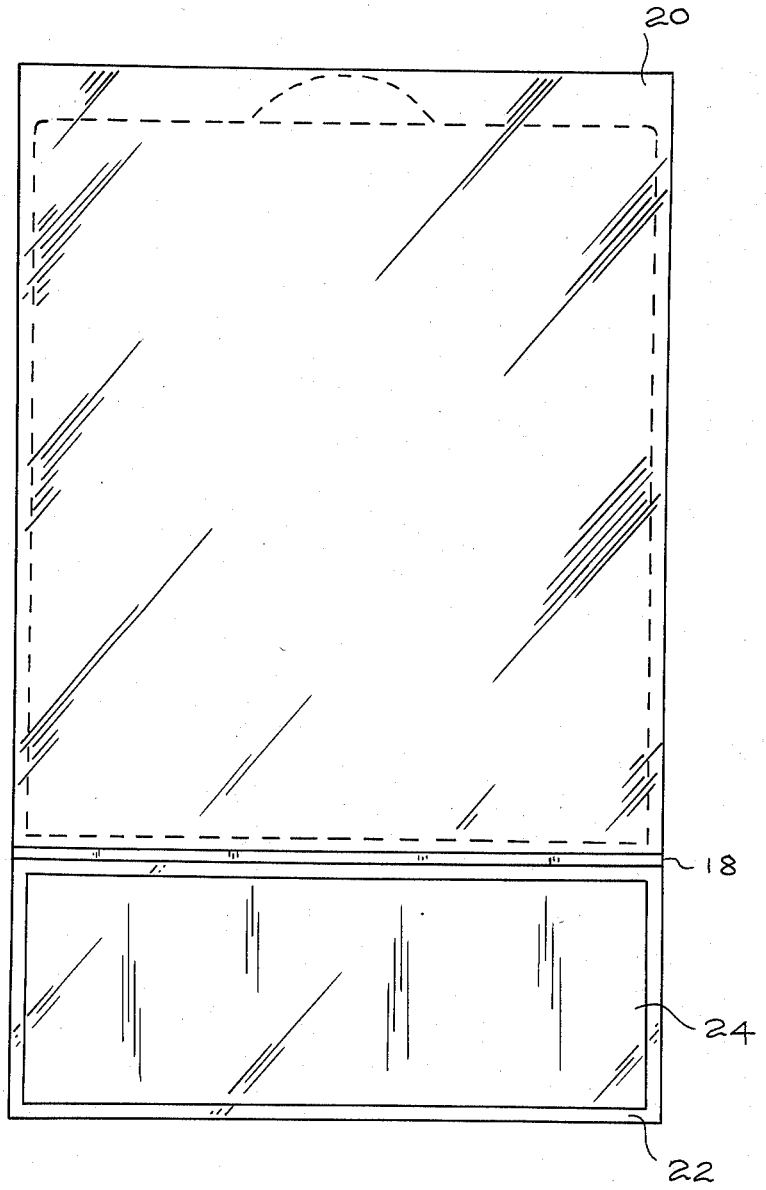
FIG. 3 is a rear elevational view thereof.

Refering to FIGS. 1, 2 and 3, the invention is comprised of a transparent polymer package 18, having an upper portion 20, which accommodates a shirt or the like, and a lower portion 22, which accommodates a paper label insert 24 showing five pants drawings.

Figure 4:
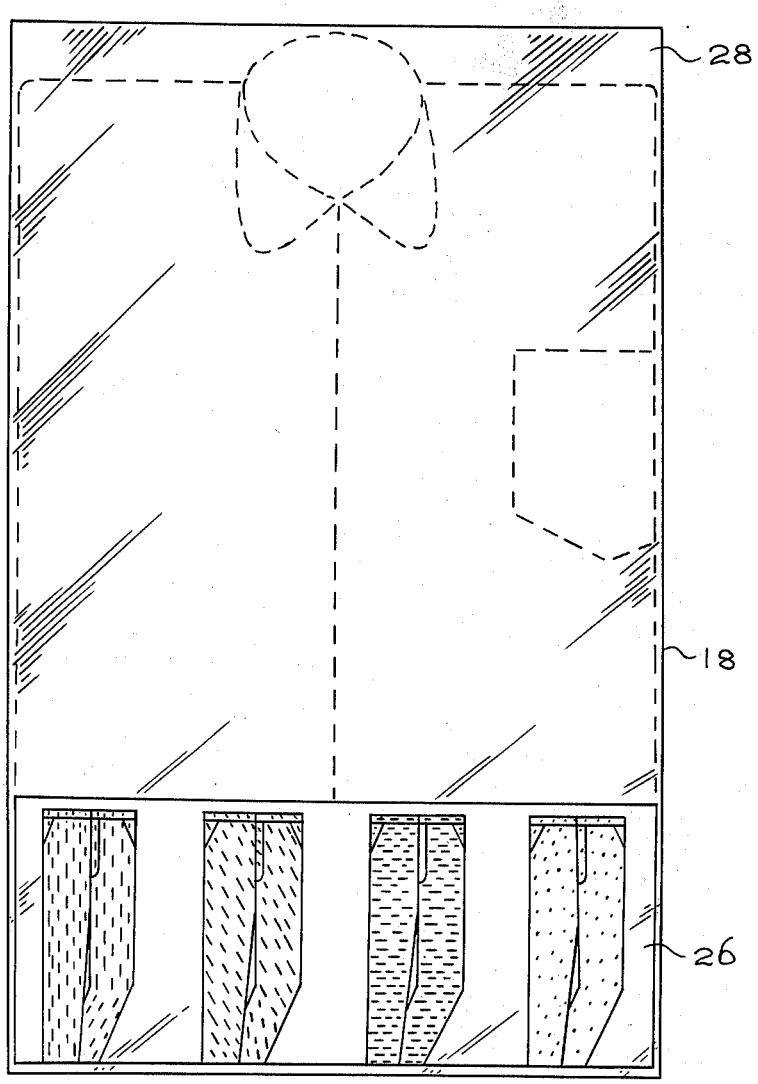
FIG. 4 is a modified embodiment of that shown in FIG. 1.
Figure 5:
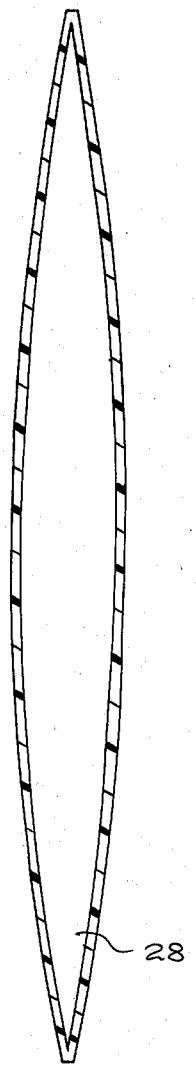
FIG. 5 is a side cross-sectional view of that shown in FIG. 4.
Figure 6:
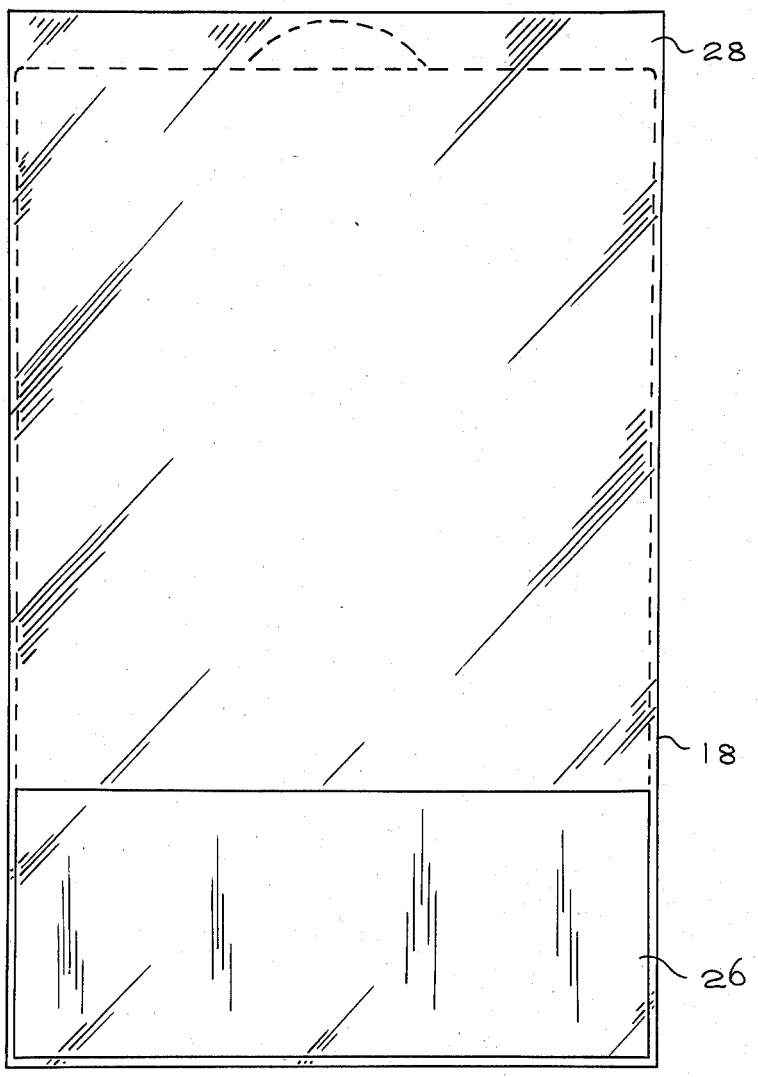
FIG. 6 is a rear elevational view of that shown in FIG. 4.
Figure 7:
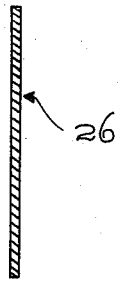
Figure 8:
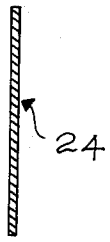

FIG. 4 is a modified embodiment of FIG. 1, in that the paper label insert 26 (shown as 24 in FIG. 1), details four pants drawings instead of five; and that the transparent polymer package 18, has a singular chamber 28, unlike dual chambers 20 and 22, of FIG. 1.

Additionally, in said modified embodiment of FIG. 4, the paper label insert 26, is placed to the bottom end of chamber 28, so as to cover the bottom end of a shirt or the like, when it is folded and placed therein said chamber 28.

In use, each pants drawing thereon paper label inserts 24 and 26, is colored to compliment the color of the shirt within said package.

It should be clear that other embodiments such as placement of the label inserts 24 and 26, so as to be visible from the rear of the package, or label inserts showing a color palette, not necessarily in the form of pants drawings, are contemplated as being within the scope of this invention, which is not to be construed as limited to the particular forms shown herein, which are to be considered illustrative rather than restrictive.

I claim:

1. A package for packaging a shirt comprising transparent means for enclosing and displaying said shirt and a label insert located adjacent thereto, said insert comprising a drawing of at least four differently colored pants that can be coordinated to be worn with the color of the enclosed shirt.

2. The package of claim 1 wherein the insert contains at least five pants.

3. The package of claim 1 wherein said transparent means includes two compartments, one housing the shirt and the other the label insert.

4. The pacakge of claim 1 wherein said transparent means includes one compartment housing both said shirt and said insert.

5. The package of claim 1 wherein said transparent means is a polymer package.

* * * * *